US010205264B2

(12) United States Patent
Washio et al.

(10) Patent No.: US 10,205,264 B2
(45) Date of Patent: Feb. 12, 2019

(54) JOINT CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kazuhiro Washio, Mie (JP); Yasuo Omori, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/736,052

(22) PCT Filed: Jun. 3, 2016

(86) PCT No.: PCT/JP2016/066646
§ 371 (c)(1),
(2) Date: Dec. 13, 2017

(87) PCT Pub. No.: WO2016/208364
PCT Pub. Date: Dec. 29, 2016

(65) Prior Publication Data

US 2018/0183171 A1 Jun. 28, 2018

(30) Foreign Application Priority Data

Jun. 22, 2015 (JP) ..... 2015-124767

(51) Int. Cl.
*H01R 13/514* (2006.01)
*H01R 13/436* (2006.01)
(Continued)

(52) U.S. Cl.
CPC ..... *H01R 13/4361* (2013.01); *H01R 13/42* (2013.01); *H01R 13/506* (2013.01);
(Continued)

(58) Field of Classification Search
CPC .. H01R 13/514; H01R 9/2408; H01R 13/506; H01R 9/24; H01R 31/02; H01R 31/08; H01R 31/085; H01R 9/2675; H01R 9/26
(Continued)

(56) References Cited

U.S. PATENT DOCUMENTS 3,753,216 A * 8/1973 Johnson ..... H01R 9/26 439/491
4,313,646 A * 2/1982 Millhimes ..... H01R 31/02 439/215
(Continued)

FOREIGN PATENT DOCUMENTS

JP 2-148583 6/1990
JP 5-84076 11/1993
(Continued)

OTHER PUBLICATIONS

International Search Report dated Aug. 16, 2016.

*Primary Examiner* — Gary Paumen
(74) *Attorney, Agent, or Firm* — Gerald E. Hespos; Michael J. Porco; Matthew T. Hespos

(57) ABSTRACT

A joint connector includes shorting members (30) and a shorting member accommodating portion (50) for holding the shorting members (30). The shorting member holding portion (50) includes clamping portions (52, 54, 56 and 58) capable of clamping the shorting members (30) from both sides in a clamping direction and a clamping/fixing portion for constraining these clamping portions (52, 54, 56 and 58) to each other to fix the clamping portions at clamping positions where the clamping portions clamp the shorting
(Continued)

members (30). At least some of the clamping portions are constraining clamping portions including shorting member constraining portions for constraining the shorting members (30) to restrict relative displacements of the shorting members (30) in a terminal projecting direction at the clamping positions.

8 Claims, 12 Drawing Sheets

(51) Int. Cl.
*H01R 13/42* (2006.01)
*H01R 31/08* (2006.01)
*H01R 13/506* (2006.01)
*H01R 13/518* (2006.01)

(52) U.S. Cl.
CPC ..... *H01R 13/514* (2013.01); *H01R 13/518* (2013.01); *H01R 31/08* (2013.01); *H01R 31/085* (2013.01); *H01R 2201/26* (2013.01)

(58) Field of Classification Search
USPC ..... 439/507, 511, 701, 712, 714, 715, 709, 439/710
See application file for complete search history.

(56) References Cited

U.S. PATENT DOCUMENTS

| | | | | |
|---|---|---|---|---|
| 5,122,077 | A | 6/1992 | Maejima et al. | |
| 8,388,364 | B2 * | 3/2013 | Kikuchi | H01R 13/08 439/251 |
| 2005/0079758 | A1 * | 4/2005 | Fujii | H01R 31/08 439/507 |
| 2018/0131117 | A1 * | 5/2018 | Washio | H01R 13/42 |

FOREIGN PATENT DOCUMENTS

| | | |
|---|---|---|
| JP | 2004-134103 | 4/2004 |
| JP | 2005-259722 | 9/2005 |
| JP | 2005-353361 | 12/2005 |

* cited by examiner

FIG. 9
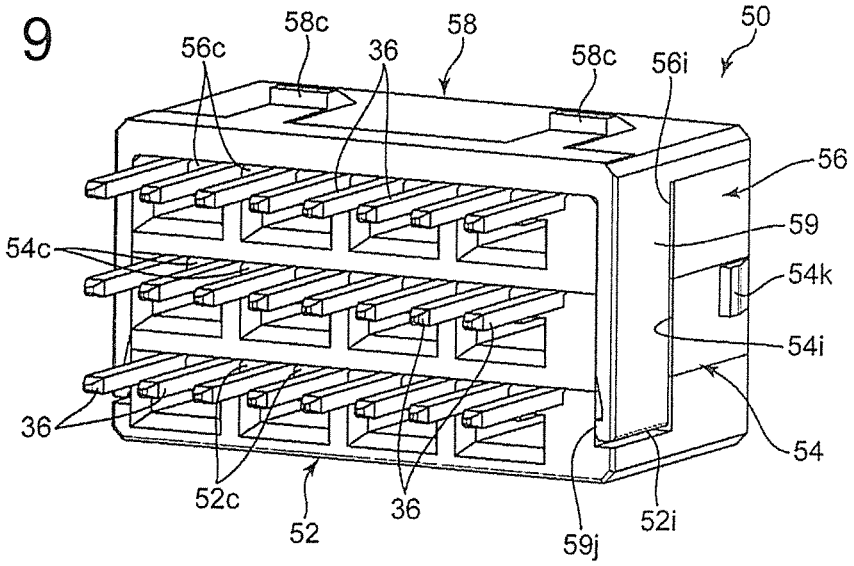
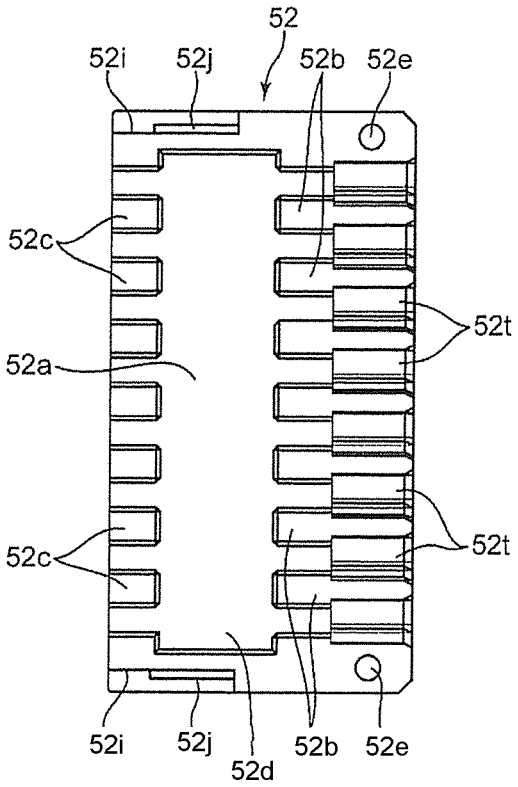
FIG. 10

FIG. 11
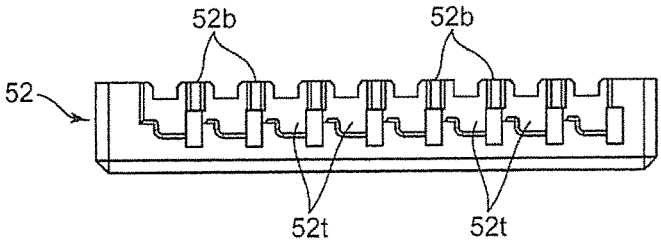
FIG. 12
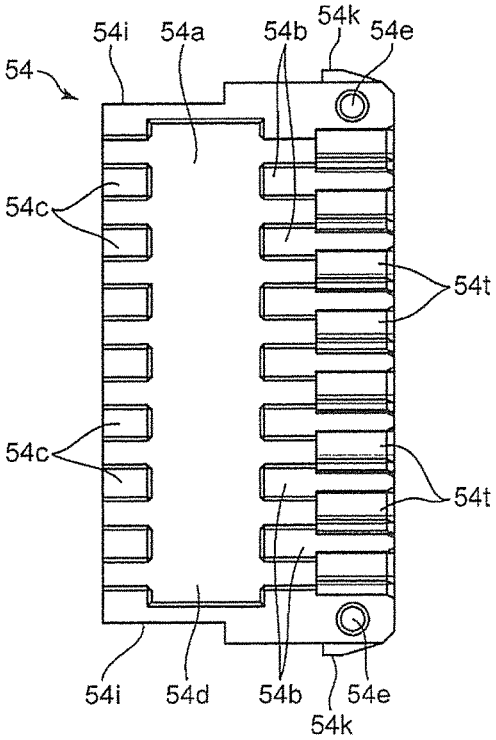
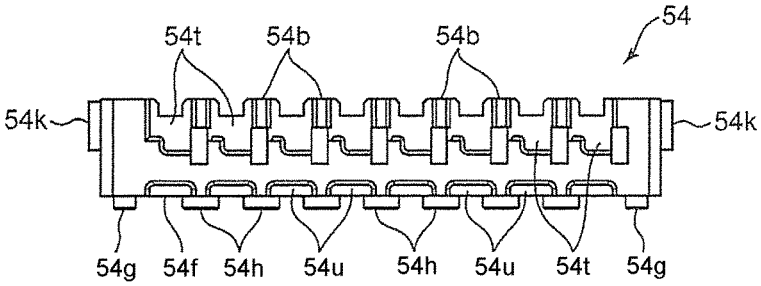
FIG. 13

FIG. 14
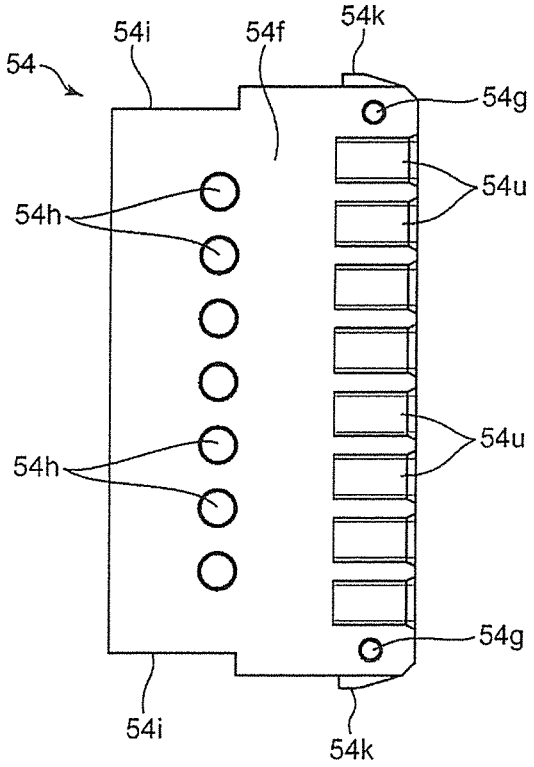
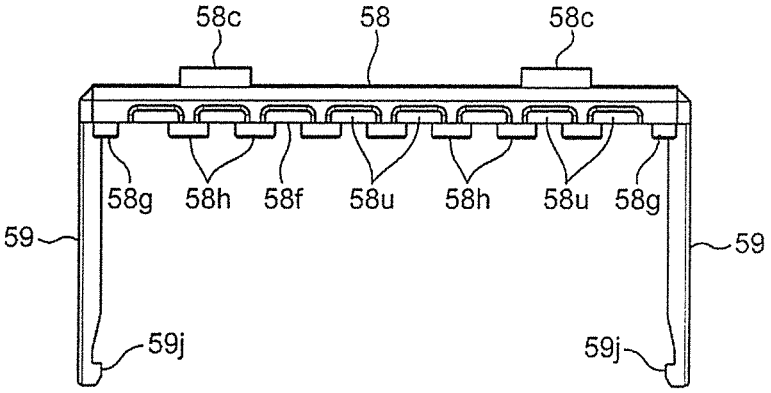
FIG. 15

JOINT CONNECTOR

BACKGROUND

Field of the Invention

The invention relates to a joint connector for electrically shorting wires included in a wiring harness of an automotive vehicle or the like to each other.

Description of the Related Art

A conventional joint connector shorts wires in a wiring harness of an automotive vehicle or the like to each other. For example, Japanese Unexamined Patent Publication No. 2005-353361 discloses a joint connector with a housing for receiving female wire-side terminals respectively crimped to ends of wires to be shorted. A joint terminal is fixed in this housing and shorts the wire-side terminals. The joint terminal integrally includes a busbar extending in an arrangement direction of the wire-side terminals and tab-like terminals extending from this busbar in a direction perpendicular to a longitudinal direction of the busbar. The respective tab-like terminals are fit to the corresponding wire-side terminals, and the wires are shorted to each other by this fitting. The joint terminal needs to be fixed in the housing so as to be held in the housing against a fitting force of the wire-side terminal to the tab-like terminal (force required to fit and separate the terminals). Japanese Unexamined Patent Publication No. 2005-353361 discloses a joint connector housing that includes an intermediate wall with insertion holes into which the respective tab-like terminals of the joint terminal can be press-fit. Specifically, the joint terminal is held in the housing by press-fitting each tab-like terminal included in the joint terminal into each insertion hole.

Setting press-fitting resistance is a problem in the joint connector in which the joint terminal is fixed in the housing by press-fitting the tab-like terminals into the insertion holes. Specifically, for the housing to hold the joint terminal with a holding force sufficient to resist the fitting force, the press-fitting resistance has to be set large. However, the larger the press-fitting resistance, the higher a possibility of cracking resin of the housing or a possibility of fracture of the tab-like terminals due to buckling or the like during a press-fitting operation. In recent years, wires have become thinner, and terminals have become smaller and narrower. Thus, there is a high possibility of fracture of the tab-like terminals caused by the large press-fitting resistance.

An object of the invention is to provide a joint connector with a shorting member to be fit to a plurality of wire-side terminals respectively mounted on a plurality of wires and an insulating housing for holding the shorting member and in which the insulating housing can hold the shorting member with a sufficient holding force without possibly causing the fracture of the insulating housing or the shorting member.

SUMMARY

The invention is directed to a joint connector for shorting wires to each other by electrically connecting wire-side terminals respectively mounted on ends of the wires. The joint connector includes a shorting member made of a conductive material. The shorting member integrally includes a base extending in a shorting direction and shorting-side terminals projecting from the base in a terminal projecting direction that intersects the shorting direction.

Each shorting-side terminal is shaped to fit to each wire-side terminal. The joint connector also includes an insulating housing having a shorting member holding portion for holding the shorting member. The shorting member holding portion includes first and second clamping portions divided from each other in a clamping direction perpendicular to the shorting direction and the terminal projecting direction and capable of clamping the shorting member from both sides in the clamping direction. A clamping/fixing portion constrains the first and second clamping portions to each other to fix relative positions of the first and second clamping portions at such clamping positions where the first and second clamping portions clamp the shorting member from the both sides in the clamping direction. At least one of the first and second clamping portions is a constraining clamping portion including a shorting member constraining portion for constraining the shorting member to restrict a relative displacement of the shorting member in the terminal projecting direction with respect to the first and second clamping portion at the clamping position.

The joint connector may include a shorting member to be fit to wire-side terminals respectively mounted on ends of wires and an insulating housing for holding the shorting member and in which the insulating housing can hold the shorting member with a sufficient holding force without possibly causing the fracture of the insulating housing or the shorting member.

The joint connector shorts wires to each other by electrically connecting wire-side terminals respectively mounted on ends of the wires to each other. The joint connector includes a shorting member made of a conductive material, integrally including a base extending in a shorting direction and shorting-side terminals projecting from the base in a terminal projecting direction that intersects the shorting direction. Each shorting-side terminal portion is shaped to fit to each wire-side terminal. An insulating housing having a shorting member holding portion holds the shorting member. The shorting member holding portion includes a first clamping portion and a second clamping portion divided from each other in a clamping direction perpendicular to the shorting direction and the terminal projecting direction and capable of clamping the shorting member from both sides in the clamping direction, and a clamping/fixing portion for constraining the first and second clamping portions to each other to fix relative positions of the first and second clamping portions at such clamping positions where the first and second clamping portions clamp the shorting member from the both sides in the clamping direction. At least one of the first and second clamping portions is a constraining clamping portion including a shorting member constraining portion for constraining the shorting member to restrict a relative displacement of the shorting member in the terminal projecting direction with respect to the first and second clamping portion at the clamping position.

The clamping/fixing portion constrains the first and second clamping portions to each other in a state where the first and second clamping portions clamp the shorting member therebetween, i.e. in a state where the relative positions of the first and second clamping portions are the clamping positions. In addition, the shorting member constraining portion included in at least one of the first and second clamping portions constrains the shorting member to restrict the relative displacement of the shorting member in the terminal projecting direction with respect to the first and second clamping portions at the clamping position. Therefore, the first and second clamping portions can hold the shorting member against a fitting force acting on the shorting member, i.e. a force acting on the shorting member in fitting and separating the shorting-side terminal portions of the shorting member and the wire-side terminals. Thus, the insulating housing can hold the shorting member with a holding force sufficient to resist the fitting force without requiring an operation of tightly press-fitting the shorting member into an insertion hole provided in a housing.

The first and second clamping portions may include clamping surfaces facing each other in the clamping direction at the clamping positions, and the shorting member constraining portion includes constraining protrusions projecting from the clamping surface of the constraining clamping portion toward the mating clamping portion. This structure enables the clamping of the shorting member and the constraint of the shorting member in the terminal projecting direction by a simple shape formed by a combination of the clamping surfaces and the constraining protrusions projecting from at least one of the clamping surfaces.

The constraining protrusions may include those for constraining the base in a direction parallel to the terminal projecting direction by being located at positions between adjacent ones of the plurality of shorting-side terminals and near the base and constraining the shorting-side terminals in a direction perpendicular to the terminal projecting direction. The constraining protrusions can constrain both the base in the direction parallel to the terminal projecting direction and the shorting-side terminals in the direction perpendicular to the terminal projecting direction by a simple shape.

If the shorting member includes a through hole penetrating through the base thereof in a direction parallel to the clamping direction, the constraining protrusions may include a through hole inserting protrusion to be inserted into the through hole in the direction parallel to the clamping direction at the clamping position. This through hole inserting protrusion can reliably constrain the shorting member in the directions perpendicular to the clamping direction (i.e. including the shorting direction and the terminal projecting direction) by being inserted into the through hole.

The joint connector may include shorting members arranged in the direction parallel to the clamping direction as the shorting member. In this case, the shorting member holding portion may include the first and second clamping portions for each shorting member.

The shorting member holding portion can include a common clamping portion interposed between adjacent shorting members and commonly used as the first clamping portion for one of the adjacent shorting members and as the second clamping portion for the other shorting member. This common clamping portion enables the shorting members to be clamped by a simple structure with a small number of components.

The clamping/fixing portion can collectively fix relative positions of the first and second clamping portions for clamping each of the shorting members at the clamping positions by coupling both outer clamping portions located on both outer sides in the direction parallel to the clamping direction. The clamping/fixing portion of this type enables the shorting members to be clamped by a simpler structure than clamping/fixing portions for individually fixing the relative positions of the first and second clamping portions relating to each shorting member. The above clamping/fixing portion can also be formed to be connected integrally to one of the outer clamping portions.

BRIEF DESCRIPTION OF THE DRAWINGS

FIG. 9 is an assembled perspective view of the shorting member holding portion.

FIG. 10 is a plan view of a lower clamping portion of the shorting member holding portion.

FIG. 11 is a front view of the lower clamping portion viewed from the side of a terminal holding portion.

FIG. 12 is a plan view of a first intermediate clamping portion of the shorting member holding portion.

FIG. 13 is a front view of the first intermediate clamping portion viewed from the side of the terminal holding portion.

FIG. 14 is a bottom view of the first intermediate clamping portion.

FIG. 15 is a front view of an upper clamping portion of the shorting member holding portion viewed from the side of the terminal holding portion.

DETAILED DESCRIPTION

Figure 1:
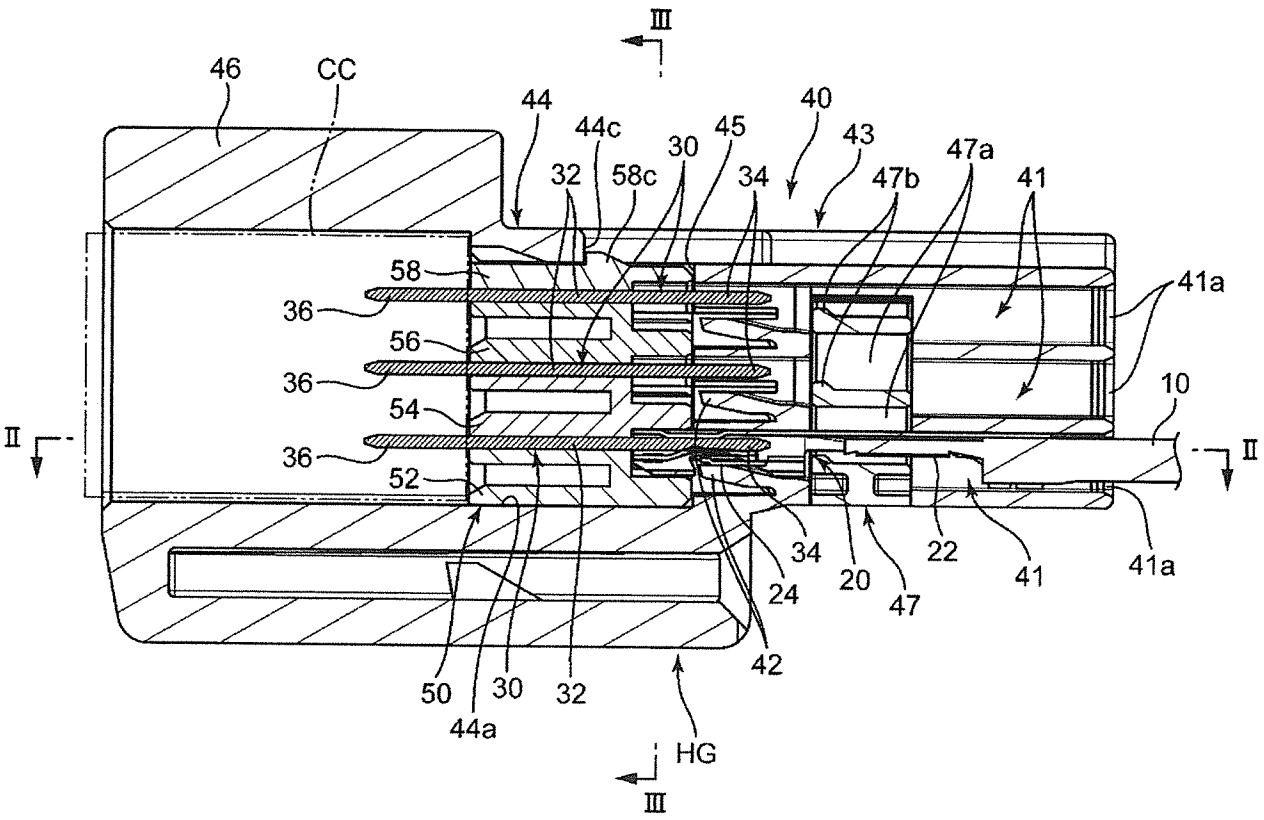
FIG. 1 is a side view in section of a joint connector according to one embodiment of the present invention.
Figure 2:
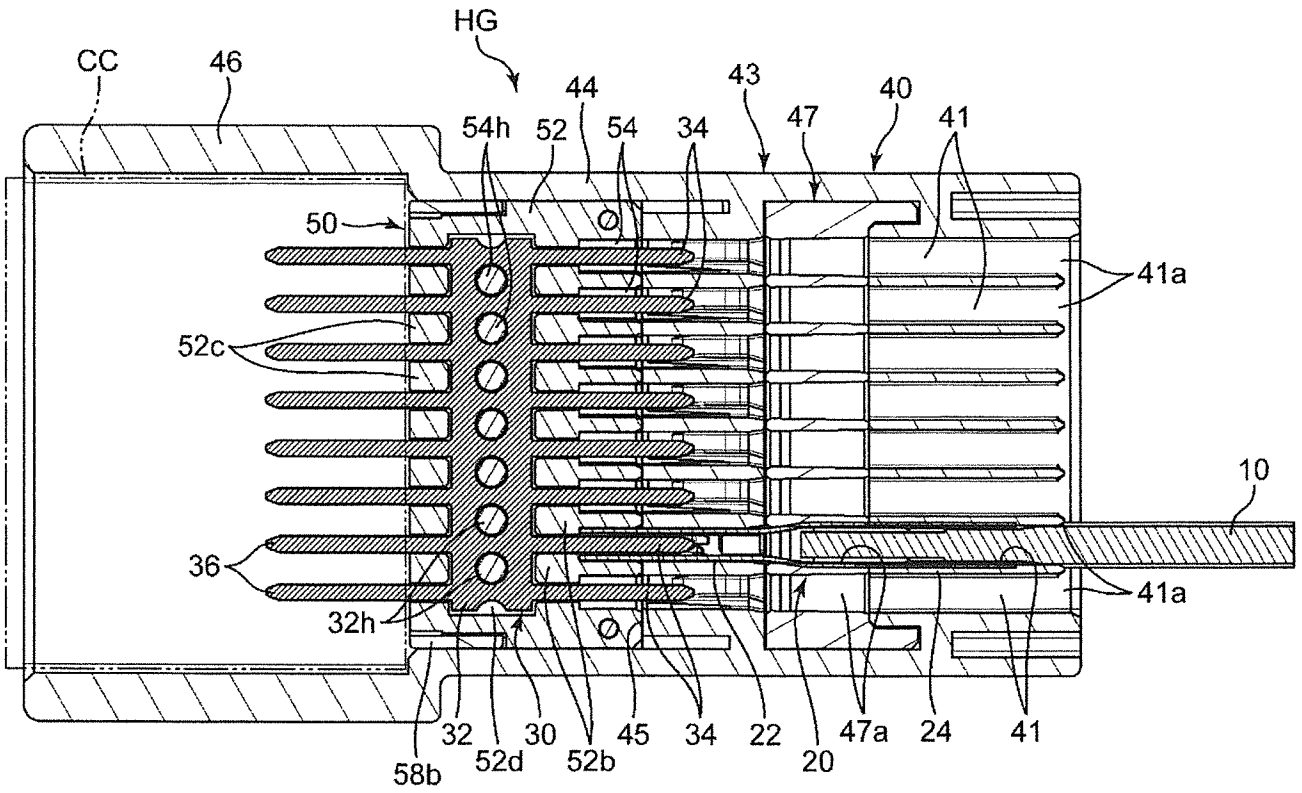
FIG. 2 is a plan view in section along II-II of FIG. 1.
Figure 3:
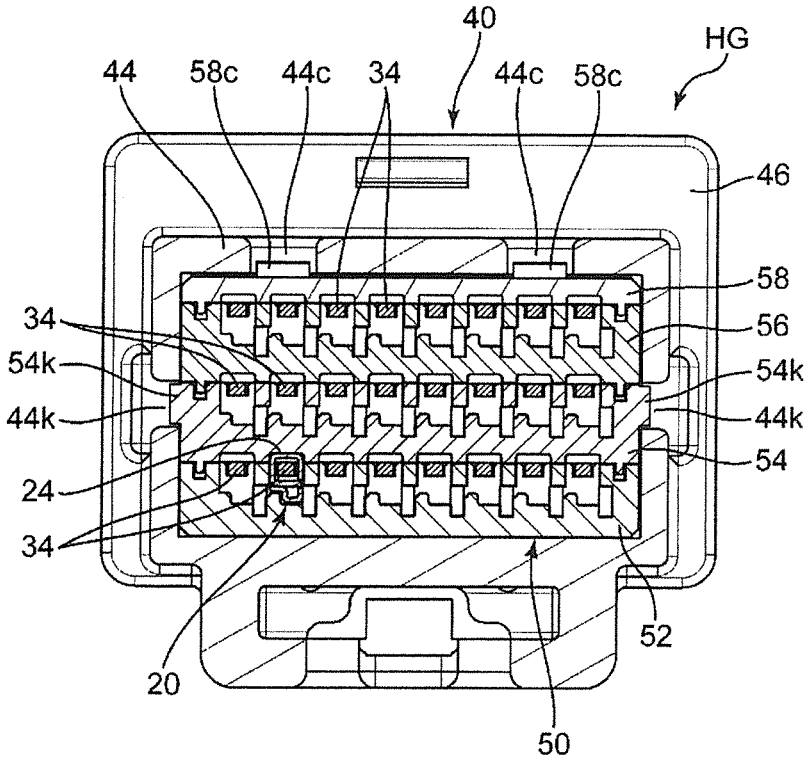
FIG. 3 is a front view in section along III-III of FIG. 1.

FIGS. 1 to 16 show a joint connector according to one embodiment of the invention. This joint connector is for shorting wire-side terminals 20 respectively mounted on ends of wires 10 to each other and includes shorting members 30 and an insulating housing HG for holding the shorting members 30.

In this embodiment, each of the wire-side terminals 20 is a female terminal and includes a wire crimping portion 22 and an electrical contact portion 24, and these portions are formed of a single metal plate. The wire crimping portion 22 is to be crimped to the end of the wire 10. This crimping enables electrical conduction between the wire-side terminal and a conductor part of the wire 10. The electrical contact portion 24 is configured to electrically contact the shorting member 30, i.e. to contact the shorting member 30 to form electrical conduction, by being fit to the shorting member 30. The electrical contact portion 24 according to this embodiment is of a female type and receives the shorting member 30 fit therein.

Each of the shorting members 30 is formed of a conductor and integrally includes a base 32, first shorting-side terminals 34 and second shorting-side terminals 36. Each shorting member 30 of this embodiment is formed of a single flat metal plate.

The base 32 extend in a specific shorting direction, a connector lateral direction in this embodiment, while having a constant width. Further, this base 32 is formed with pilot through holes **32*h* for transferring the base portion 32 in forming the shorting member 30. The pilot through holes 32*h*** are arranged in the connector lateral direction.

The first shorting-side terminals 34 are arranged at intervals (equal intervals in a shown example) in the connector lateral direction and project in a first projecting direction, which is a terminal projecting direction perpendicular to this specific direction. Each first shorting-side terminal 34 is a male terminal (tab) that fits into the female electrical contact portion 24, thereby being able to electrically contact the electrical contact portion 24.

The second shorting-side terminals 36 are arranged at intervals (equal intervals, like the first shorting-side terminal portions 34, in a shown example) in the specific direction and project from the base in a second projecting direction, which is a terminal projecting direction opposite to the first projecting direction. The respective second shorting-side terminal portions 36 are shaped to fit to connector terminals included in a mating connector CC shown by chain double-dashed line in FIGS. 1 and 2. The mating connector CC is provided on an end of a wire bundle different from the wires 10.

The insulating housing HG includes an outer portion 40 having a part for holding each wire-side terminal 20 and a shorting member accommodating portion 50 for accommodating the shorting members 30.

The outer portion 40 is molded of an insulating material such as synthetic resin and includes a terminal holding portion 43, a casing 44, a receptacle 46 and a retainer 47. The terminal holding portion 43, the casing 44 and the receptacle 46 are molded integrally as an outer portion body formed of a single member, and the retainer 47 is mounted into the outer portion body as a member different from the outer portion body.

The terminal holding portion 43 has terminal accommodating chambers 41 and a locking lance 42 is provided in each of the terminal accommodating chambers 41.

The terminal accommodating chambers 41 are shaped to receive the wire-side terminals 20 inserted along axial directions of the wire-side terminals 20. Specifically, the terminal accommodating chambers 41 are arranged side by side in vertical and horizontal directions, i.e. arranged laterally side by side in the connector lateral direction, which is an extending direction of the base 32 of each shorting member 30, in each of plural of stages located one above another. Each terminal accommodating chamber 41 includes a terminal insertion opening 41*a* open on one axial side (right side in FIGS. 1 and 2). Each wire-side terminal 20 can be inserted into the corresponding terminal accommodating chamber 41 through the terminal insertion opening 41*a* with the electrical contact portion 24 in the lead.

Figure 4:
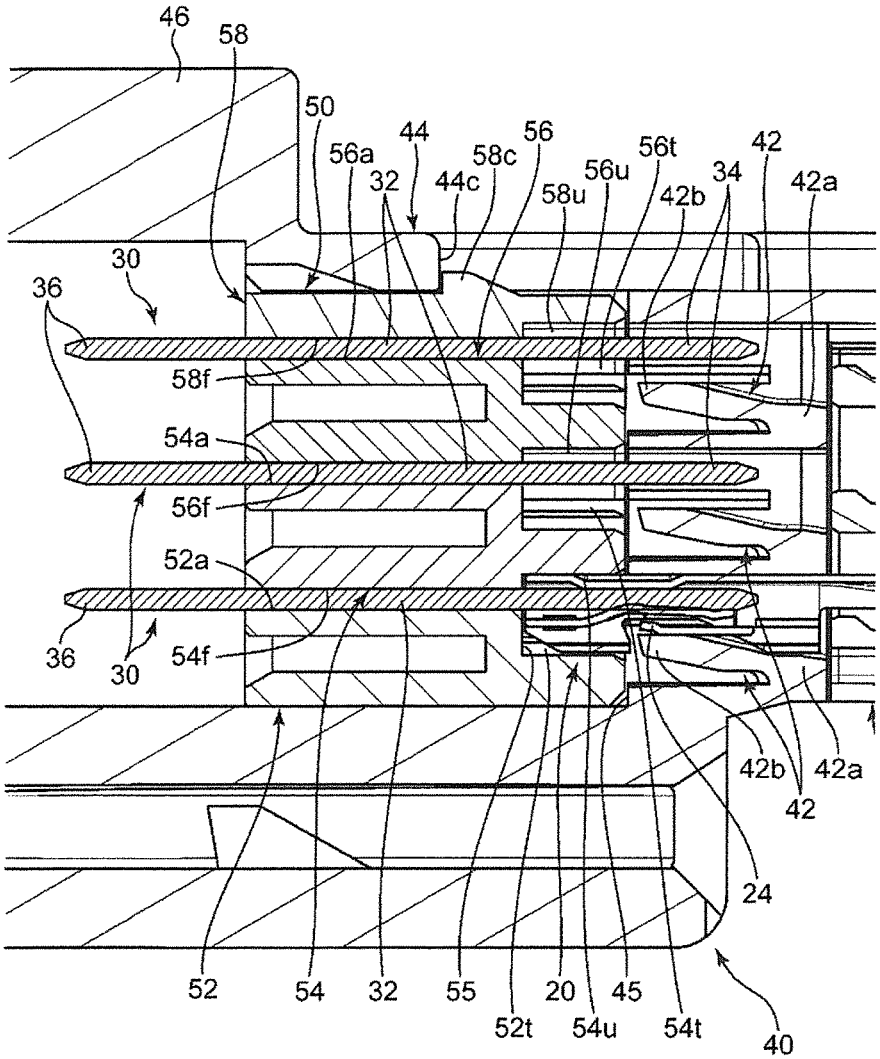
FIG. 4 is an enlarged side view in section showing an essential part of the joint connector shown in FIG. 1.

Each of the locking lances 42 defines a terminal locking portion for locking (primarily locking) the wire-side terminal 20 inserted into each terminal accommodating chamber 41. The locking lance 42 is a cantilever. Specifically, as shown in FIGS. 1 and 4, the locking lance 42 includes a base 42*a* connected to a part of a wall defining the terminal accommodating chamber 41 and a tip 42*b*, at an end part on a side opposite to the base 42*a*. This locking lance 42 is resiliently deformable such that the tip 42*b* is resiliently displaced in a direction (down in FIG. 1) perpendicular to the axial direction of the wire-side terminal 20. The locking lance 42 allows the wire-side terminal 20 to be inserted into the terminal accommodating chamber 41 by the tip 42*b* being resiliently displaced in a direction to be retracted from the wire-side terminal 20 (up in FIG. 1), while locking (primarily locking) the wire-side terminal 20 in the terminal accommodating chamber 41 by the tip 42*b* partially resiliently returning in a state where the wire-side terminal 20 is completely inserted in the terminal accommodating chamber 41. Specifically, the tip 42*b* of the locking lance 42 engages a suitable part (intermediate part of the electrical contact portion 24 in an example of FIGS. 4 and 5) of the inserted wire-side terminal 20, thereby impeding the separation of the wire-side terminal 20.

The retainer 47 is mounted into the terminal holding portion 43 in the outer portion body to lock (secondarily lock) the wire-side terminals 20 inserted into the respective terminal accommodating chambers 41 in the terminal holding portion 43 in addition to locking by the locking lances 42. Specifically, the retainer 47 is shaped to define windows 47*a* and each window 47*a* constitutes a specific part of each terminal accommodating portion 41 behind the locking lance 42. The retainer 47 includes locking projections 47*b* for locking specific parts (rear ends of the wire crimping portions 22 in FIG. 1) of the wire-side terminals 20 inserted into the respective terminal accommodating portions 41. This retainer 47 is movable between a locking position shown in FIGS. 1 and 4 where the locking projections 47*b* lock the wire-side terminals 20 and a retracted position shifted from the locking position in a direction (down in FIG. 1) perpendicular to the axial directions of the wire-side terminals 20. At the retracted position, the window 47*a* is aligned with another part of the terminal accommodating chamber 41. Thus, the wire-side terminal 20 is permitted to be inserted into the terminal accommodating chamber 41 through the window 47*a* while penetrating through the retainer 47.

This retainer 47 can be omitted as appropriate in the present invention.

The casing 44 is a part adjacent to the terminal holding portion 43 on a side (left side in FIGS. 1 and 2) opposite to the respective terminal insertion openings 41*a* and is configured to accommodate the shorting member accommodating portion 50 while relatively displaceably holding the shorting member holding portion 50. The receptacle 46 is a part extending from the casing 44 toward a side (left side in FIGS. 1 and 2) opposite to the terminal holding portion 43. These casing 44 and receptacle 46 are described in detail later.

The shorting member accommodating portion 50 is molded of an insulating material, such as synthetic resin, as a member different from the outer portion 40 and has a substantially rectangular parallelepiped shape in this embodiment. The shorting member accommodating portion 50 accommodates each of the shorting members 30. Specifically, the shorting member holding portion 50 holds the respective shorting members 30 in the stages located one above another with a plate thickness direction of the shorting members 30 aligned vertically and with the shorting members 30 penetrating through the shorting member holding portion 50 in a direction parallel to the axial directions of the wire-side terminals 20.

This shorting member accommodating portion 50 is accommodated and held in the casing 44 of the outer portion 40. This shorting member accommodating portion 50 is held at a position where the first shorting-side terminal portions 34 of each shorting member 30 can project from sides (left side in FIGS. 1 and 2) of the respective terminal accommodating chambers 41 opposite to the terminal insertion openings 41*a* and the electrical contact portions 24 of the wire-side terminals 20 inserted in the respective terminal accommodating chambers 41 can be fit to the first shorting-side terminal portions 34 (specifically, the first shorting-side terminal portions 34 can be fit into the electrical contact portions 24).

Figure 8:
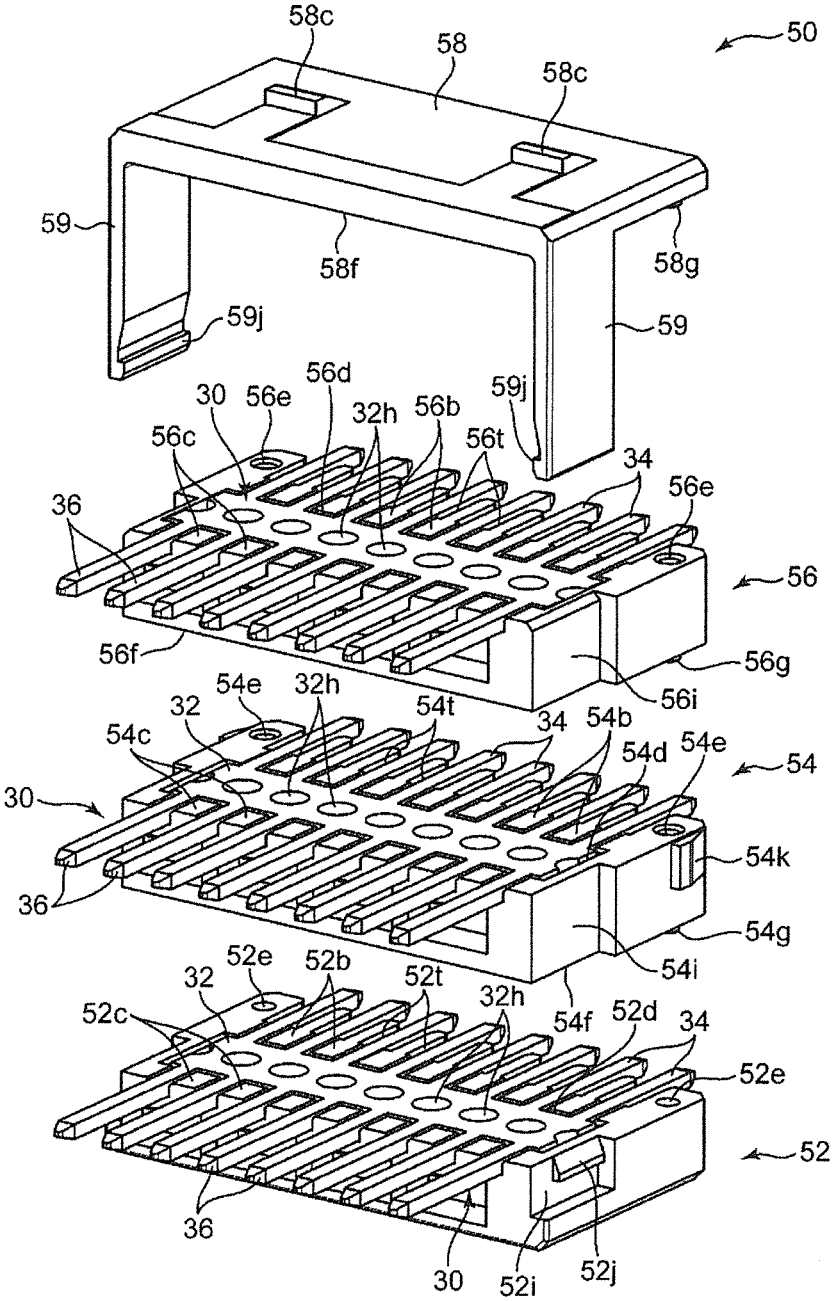
FIG. 8 is an exploded perspective view of a shorting member holding portion in the joint connector.

The shorting member accommodating portion 50 is structured to clamp each of the plurality of shorting members 30 from both vertical sides. This structure enables the shorting member holding portion 50 to hold the respective shorting members 30 while making it unnecessary to tightly press-fit the shorting members 30 into the shorting member holding portion 50. Specifically, the shorting member holding portion 50 is divided into a lower clamping portion 52, a first intermediate clamping portion 54, a second intermediate clamping portion 56 and an upper clamping portion 58 as shown in FIGS. 8 and 9. These clamping portions 52, 54, 56 and 58 clamp the respective shorting members 30 from both vertical sides by being stacked in this order from the bottom. Specifically, the shorting member holding portion 50 has the following configuration for each of the shorting members 30.

i) The lower clamping portion 52 and the first intermediate clamping portion 54 constitute first and second clamping portions for clamping the lowermost shorting member 30 from both upper and lower sides.

ii) The first intermediate clamping portion 54 and the second intermediate clamping portion 56 constitute first and second clamping portions for clamping the middle shorting member 30 from both upper and lower sides.

iii) The second intermediate clamping portion 56 and the upper clamping portion 58 constitute first and second clamping portions for clamping the uppermost shorting member 30 from both upper and lower sides.

That is, the first intermediate clamping portion 54 corresponds to a common clamping portion commonly used as the second clamping portion relating to the lowermost shorting member 30 and the first clamping portion relating to the middle shorting member 30, the second intermediate clamping portion 56 corresponds to a common clamping portion commonly used as the second clamping portion relating to the middle shorting member 30 and the first clamping portion relating to the uppermost shorting member 30, and the lower clamping portion 52 and the upper clamping portion 58 correspond to both outer clamping portions located on both sides in the vertical direction parallel to a clamping direction of each shorting member 30.

As also shown in FIGS. 10 and 11, the lower clamping portion 52 includes a clamping surface 52*a*, first constraining protrusions 52*b*, second constraining protrusions 52*c* and two positioning holes 52*e*.

The clamping surface 52*a* is configured by the upper surface of the lower clamping portion 52 and faces the lower surface of the lowermost shorting member 30. Thus, the clamping surface 52*a* faces up and is below the lowermost shorting member 30, as shown in FIG. 4.

The first constraining protrusions 52*b* project farther up than the clamping surface 52*a* at positions between adjacent ones of the first shorting-side terminals 34 of the lowermost shorting member 30 and near the base 32, thereby constraining the base 32 to restrict a relative displacement of the lowermost shorting member 30 in the first projecting direction with respect to the lower clamping portion 52 and constraining the first shorting-side terminal portions 34 to restrict relative displacement of the lowermost shorting member 30 in the connector lateral direction with respect to the lower clamping portion 52. Similarly, the second constraining protrusions 52*c* project farther up than the clamping surface 52*a* at positions between adjacent ones of the second shorting-side terminal portions 36 of the lowermost shorting member 30 and near the base 32, thereby constraining the base 32 to restrict a relative displacement of the lowermost shorting member 30 in the second projecting direction with respect to the lower clamping portion 52 and constraining the second shorting-side terminal portions 36 to restrict a relative displacement of the lowermost shorting member 30 in the connector lateral direction with respect to the lower clamping portion 52. In other words, the first and second constraining protrusions 52*b*, 52*c* are recesses, into which the base 32 and base end parts of the first and second shorting-side terminal portions 34, 36 of the lowermost shorting member 30 fit, and surround a recess 52*d* having the clamping surface 52*a* as a bottom.

The positioning holes 52*e* are for fixing relative positions of the lower clamping portion 52 and the first intermediate clamping portion 54, and open up (open toward the first intermediate clamping portion 54) on both ends of the lower clamping portion 52 in the connector lateral direction.

The lower clamping portion 52 further is formed with wire-side terminal receiving recesses 52*t* corresponding to the respective first shorting-side terminals 34 of the lowermost shorting member 30. Each wire-side terminal receiving recess 52*t* is shaped to receive the electrical contact portion 24 of the wire-side terminal 20 to be fit to the first shorting-side terminal 34 corresponding to the wire-side terminal receiving recess 52*t*.

As also shown in FIGS. 12 to 14, the first intermediate clamping portion 54 includes an upper clamping surface 54*a*, first constraining protrusions 54*b*, second constraining protrusions 54*c*, two positioning holes 54*d*, a lower clamping surface 54*f*, two positioning projections 54*g*, third constraining protrusions 54*h* and two locked projections 54*k*.

The upper clamping surface 54*a* is configured by the upper surface of the first intermediate clamping portion 54 and faces the lower surface of the middle shorting member 30. That is, this upper clamping surface 54*a* is facing up and is below the middle shorting member 30, as shown in FIG. 4.

The first constraining protrusions 54*b* project farther up than the upper clamping surface 54*a* at positions between adjacent ones of the first shorting-side terminals 34 of the middle shorting member 30 and near the base 32, thereby constraining the base 32 to restrict a relative displacement of the middle shorting member 30 in the first projecting direction with respect to the first intermediate clamping portion 54 and constraining the first shorting-side terminals 34 to restrict a relative displacement of the middle shorting member 30 in the connector lateral direction with respect to the first intermediate clamping portion 54. Similarly, the second constraining protrusions 54*c* project farther up than the upper clamping surface 54*a* at positions between adjacent ones of the second shorting-side terminals 36 of the middle shorting member 30 and near the base 32, thereby constraining the base 32 to restrict a relative displacement of the middle shorting member 30 in the second projecting direction with respect to the first intermediate clamping portion 54 and constraining the second shorting-side terminals 36 to restrict a relative displacement of the middle shorting member 30 in the connector lateral direction with respect to the first intermediate clamping portion 54. In other words, the first and second constraining protrusions 54*b*, 54*c* are recesses, into which the base 32 and base end parts of the first and second shorting-side terminals 34, 36 of the middle shorting member 30 can fit, and are arranged to surround a recess 54*d* having the upper clamping surface 54*a* as a bottom surface.

The positioning holes 54*e* are for fixing relative positions of the first intermediate clamping portion 54 and the second intermediate clamping portion 56, and open up toward the second intermediate clamping portion 56.

The lower clamping surface 54*f* is configured by the lower surface of the first intermediate clamping portion 54 and faces the upper surface of the lowermost shorting member 30. That is, this lower clamping surface 54*f* faces down and is arranged above the lowermost shorting member 30, as shown in FIG. 4. In other words, this lower clamping surface

54*f* vertically faces the clamping surface 52*a* of the lower clamping portion 52 and contributes to clamping the lowermost shorting member 30 together with the clamping surface 52*a*.

The two positioning projections 54*g* project farther down than the lower clamping surface 54*f* at positions respectively corresponding to the positioning holes 52*e* in the lower clamping portion 52. of the two positioning projections 54*g* are fit respectively into the two positioning holes 52*e* in stacking the first intermediate clamping portion 54 on the lower clamping portion 52, thereby fixing relative positions of the lower clamping portion 52 and the first intermediate clamping portion 54.

The third constraining protrusions 54*h* project farther down than the lower clamping surface 54*f* at positions respectively corresponding to the pilot through holes 32*h* formed in the base 32 of the lowermost shorting member 30. The third constraining protrusions 54*h* fit into the respective pilot through holes 32*h* to constrain the base 32 and to restrict displacements of the lowermost shorting member 30 in directions perpendicular to a thickness direction of this shorting member 30 (i.e. in the first and second projecting directions and the connector lateral direction) with respect to the first intermediate clamping portion 54. Specifically, each third constraining protrusion 54*h* corresponds to a through hole inserting protrusion to be inserted into the pilot through hole 32*h* of the base 32 in a direction parallel to the clamping direction at a clamping position.

The locked projections 54*k* enable the entire shorting member holding portion 50 to be locked in the outer portion 40. The locked projections 54*k* are formed on both side surfaces of the first intermediate clamping portion 54 facing in the connector lateral direction and respectively project out in the connector lateral direction.

The intermediate clamping portion 54 further is formed with lower wire-side terminal receiving recesses 54*u* corresponding to the respective first shorting-side terminals 34 of the lowermost shorting member 30 and upper wire-side terminal receiving recesses 54*t* corresponding to the respective first shorting-side terminals 34 of the middle shorting member 30. Each lower wire-side terminal receiving recess 54*u* is shaped to receive the electrical contact portion 24 of the wire-side terminal 20 to be fit to each first shorting-side terminal 34 of the lowermost shorting member 30 together with the wire-side terminal receiving recess 52*t* formed in the lower clamping portion 52. Each upper wire-side terminal receiving recess 54*t* is shaped to receive the electrical contact portion 24 of the wire-side terminal 20 to be fit to each first shorting-side terminal 34 of the middle shorting member 30.

The second intermediate clamping portion 56 is shaped identically to the first intermediate clamping portion 54 except not including the locked projections 54*k* on the first intermediate clamping portion 54. That is, the second intermediate clamping portion 56 includes an upper clamping surface 56*a* (FIG. 4), first and second constraining protrusions 56*b*, 56*c*, two positioning holes 56*e*, a lower clamping surface 56*f* (FIG. 4), two positioning projections 56*g*, and unillustrated third constraining protrusions.

The upper clamping surface 56*a* is configured by the upper surface of the second intermediate clamping portion 56 and faces the lower surface of the uppermost shorting member 30. That is, this upper clamping surface 56*a* faces up and is arranged below the uppermost shorting member 30, as shown in FIG. 4.

The first constraining protrusions 56*b* project farther up than the upper clamping surface 56*a* at positions between adjacent ones of the first shorting-side terminals 34 of the uppermost shorting member 30 and near the base 32, thereby constraining the base 32 to restrict a relative displacement of the uppermost shorting member 30 in the first projecting direction with respect to the second intermediate clamping portion 56 and constraining the first shorting-side terminals 34 to restrict a relative displacement of the uppermost shorting member 30 in the connector lateral direction with respect to the second intermediate clamping portion 56. Similarly, the second constraining protrusions 56*c* project farther up than the upper clamping surface 56*a* at positions between adjacent ones of the second shorting-side terminals 36 of the uppermost shorting member 30 and near the base 32, thereby constraining the base 32 to restrict a relative displacement of the uppermost shorting member 30 in the second projecting direction with respect to the second intermediate clamping portion 56 and constraining the second shorting-side terminals 36 to restrict a relative displacement of the uppermost shorting member 30 in the connector lateral direction with respect to the second intermediate clamping portion 56. In other words, the first and second constraining protrusions 56*b*, 56*c* are recesses, into which the base 32 and base end parts of the first and second shorting-side terminals 34, 36 of the uppermost shorting member 30 can fit, and are arranged to surround a recess 56*d* having the upper clamping surface 56*a* as a bottom.

The two positioning holes 56*e* are for fixing relative positions of the second intermediate clamping portion 56 and the upper clamping portion 58, and open up toward the upper clamping portion 58.

The lower clamping surface 56*f* is configured by the lower surface of the second intermediate clamping portion 56 and faces the upper surface of the middle shorting member 30. That is, this lower clamping surface 56*f* faces down and is arranged above the middle shorting member 30, as shown in FIG. 4. In other words, this lower clamping surface 56*f* vertically faces the upper clamping surface 54*a* of the first intermediate clamping portion 54 and contributes to clamping the middle shorting member 30 together with the upper clamping surface 54*a*.

The two positioning projections 56*g* project farther down than the lower clamping surface 56*f* at positions respectively corresponding to the two positioning holes 54*e* in the first intermediate clamping portion 54. of the two positioning projections 56*g* respectively fit into the two positioning holes 54*e* in stacking the second intermediate clamping portion 56 on the first intermediate clamping portion 54, thereby fixing relative positions of the first and second intermediate clamping portions 54, 56.

The third constraining protrusions correspond to through hole inserting protrusions to be inserted into the pilot through holes 32*h* of the base 32 of the middle shorting member 30 in a direction parallel to the clamping direction at the clamping position similarly to the third constraining protrusions 54*h* on the first intermediate clamping portion 54. Specifically, the third constraining protrusions of the second intermediate clamping portion 56 project farther down than the lower clamping surface 56*f* at positions respectively corresponding to the pilot through holes 32*h* formed in the base 32 of the middle shorting member 30 and constrain the base 32 to restrict relative displacements of the middle shorting member 30 in directions perpendicular to a thickness direction of this shorting member 30 (i.e. in the first and second projecting directions and the connector lateral direction) with respect to the second intermediate clamping portion 56 by being fit into the respective pilot through holes 32*h*.

The second intermediate clamping portion 56 further is formed with lower wire-side terminal receiving recesses 56*u* corresponding to the respective first shorting-side terminals 34 of the middle shorting member 30 and upper wire-side terminal receiving recesses 56*t* corresponding to the respective first shorting-side terminals 34 of the uppermost shorting member 30, as shown in FIG. 4. Each lower wire-side terminal receiving recess 56*u* is shaped to receive the electrical contact portion 24 of the wire-side terminal 20 to be fit to each first shorting-side terminal 34 of the middle shorting member 30 together with the wire-side terminal receiving recess 54*t* formed in the first intermediate clamping portion 54. Each upper wire-side terminal receiving recess 56*t* is shaped to receive the electrical contact portion 24 of the wire-side terminal 20 to be fit to each first shorting-side terminal 34 of the uppermost shorting member 30.

Figure 16:
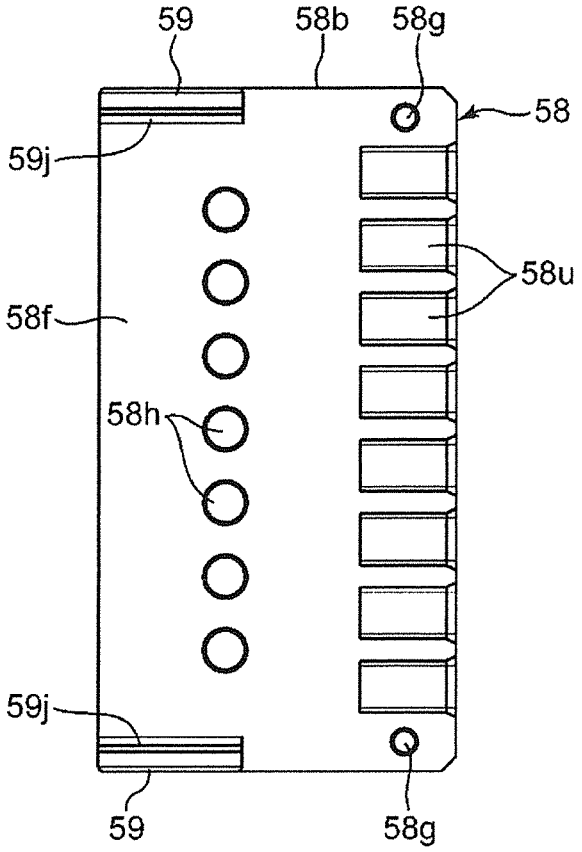
FIG. 16 is a bottom view of the upper clamping portion.

As also shown in FIGS. 15 and 16, the upper clamping portion 58 includes two locked projections 58*c*, a clamping surface 58*f*, two positioning projections 58*g* and two constraining protrusions 58*h*.

The two locked projections 58*c* enable the entire shorting member holding portion 50 to be locked in the outer portion 40 similarly to the two locked projections 54*k*. The two locked projections 58*c* are formed on the upper surface of a body 58*b* and project up.

The lower clamping surface 58*f* is configured by the lower surface of the body 58*b* and faces the upper surface of the uppermost shorting member 30. That is, this lower clamping surface 58*f* faces down and is above the uppermost shorting member 30, as shown in FIG. 4. In other words, this lower clamping surface 58*f* vertically faces the upper clamping surface 56*a* of the second intermediate clamping portion 56 and contributes to clamping the uppermost shorting member 30 together with the upper clamping surface 56*a*.

The two positioning projections 58*g* project farther down than the clamping surface 58*f* at positions respectively corresponding to the two positioning holes 56*e* in the second intermediate clamping portion 56. These two positioning projections 58*g* are fit respectively into the two positioning holes 56*e* in stacking the upper clamping portion 58 on the second intermediate clamping portion 56, thereby fixing relative positions of the second intermediate clamping portion 56 and the upper clamping portion 58.

The third constraining protrusions 58*h* project farther down than the clamping surface 58*f* at positions respectively corresponding to the pilot through holes 32*h* formed in the base 32 of the uppermost shorting member 30. The constraining protrusions 58*h* constrain the base 32 to restrict relative displacements of the uppermost shorting member 30 in directions perpendicular to a thickness direction of this shorting member 30 (i.e. in the first and second projecting directions and the connector lateral direction) with respect to the upper clamping portion 58 by being fit into the respective pilot through holes 32*h*. Specifically, each third constraining protrusion 58*h* corresponds to a through hole inserting protrusion to be inserted into the pilot through hole 32*h* of the base 32 in a direction parallel to the clamping direction at the clamping position.

The upper clamping portion 58 further is formed with wire-side terminal receiving recesses 58*u* corresponding to the respective first shorting-side terminals 34 of the uppermost shorting member 30. Each wire-side terminal receiving recess 58*u* is shaped to receive the electrical contact portion 24 of the wire-side terminal 20 to be fit to each first shorting-side terminal portion 34 of the uppermost shorting member 30 together with the upper wire-side terminal receiving recess 56*t* formed in the second intermediate clamping portion 56.

The shorting member holding portion 50 further includes clamping/fixing arms 59 corresponding to a clamping/fixing portion. These clamping/fixing arms 59 collectively fix relative positions of the clamping portions 52, 54, 56 and 58 at the clamping positions where the respective shorting members 30 can be clamped together by coupling the lower clamping portion 52 and the upper clamping portion 58, which are clamping portions on both outer sides.

The clamping/fixing arms 59 are connected integrally to the upper clamping portion 58, which is one of the outer clamping portions. Specifically, the clamping/fixing arms 59 extend from both end parts of the upper clamping portion 58 in the connector lateral direction and reach the lower clamping portion 52, which is the other of the outer clamping portions. A locking projection 59*j* is formed on a lower end part of each clamping/fixing arm 59 and projects farther in than the inner side surface of the clamping/fixing arm 59. In contrast, recesses 52*i*, 54*i* and 56*i* are formed on both side surfaces of the lower clamping portion 52 and the first and second intermediate clamping portions 54, 56 that face in the connector lateral direction. The recesses 52*i*, 54*i* and 56*i* can receive the clamping/fixing arms 59. Locked projections 52*j* are formed on the bottom surfaces of the recesses 52*i* of the lower clamping portion 52 and can be locked to the clamping/fixing arms 59 by being engaged with the locking projections 59.

Figure 5:
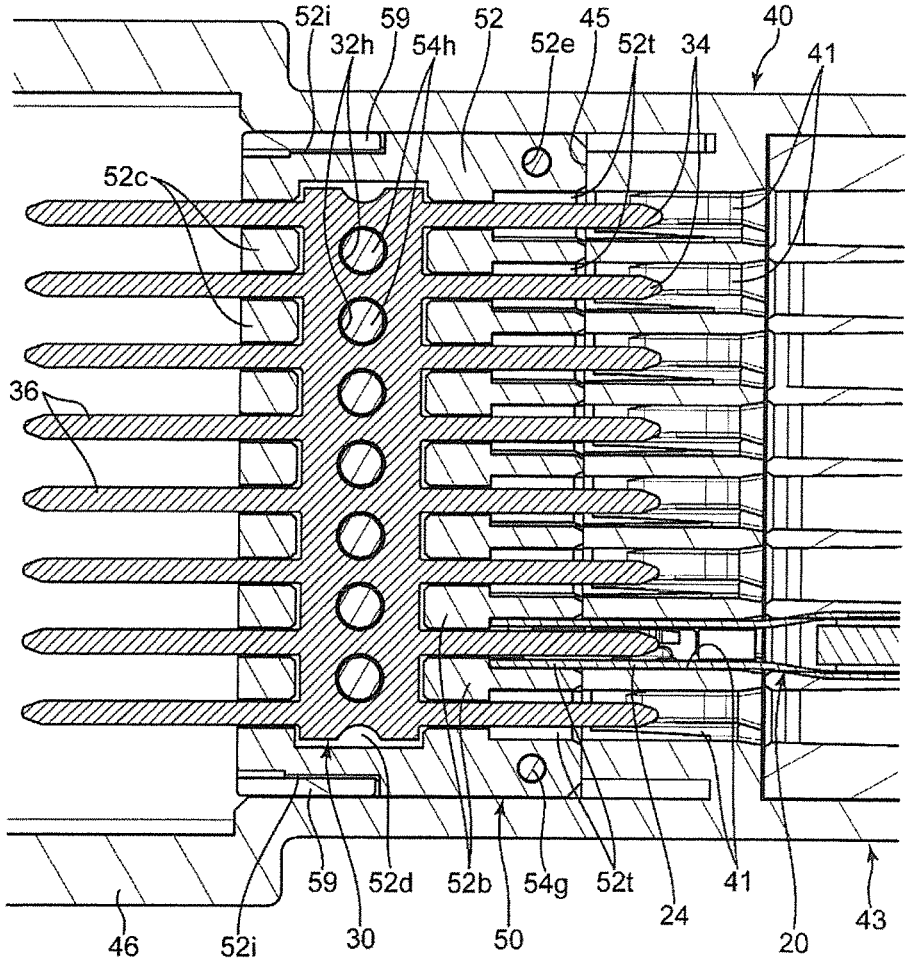
FIG. 5 is an enlarged plan view in section showing an essential part of the joint connector shown in FIG. 2.
Figure 6:
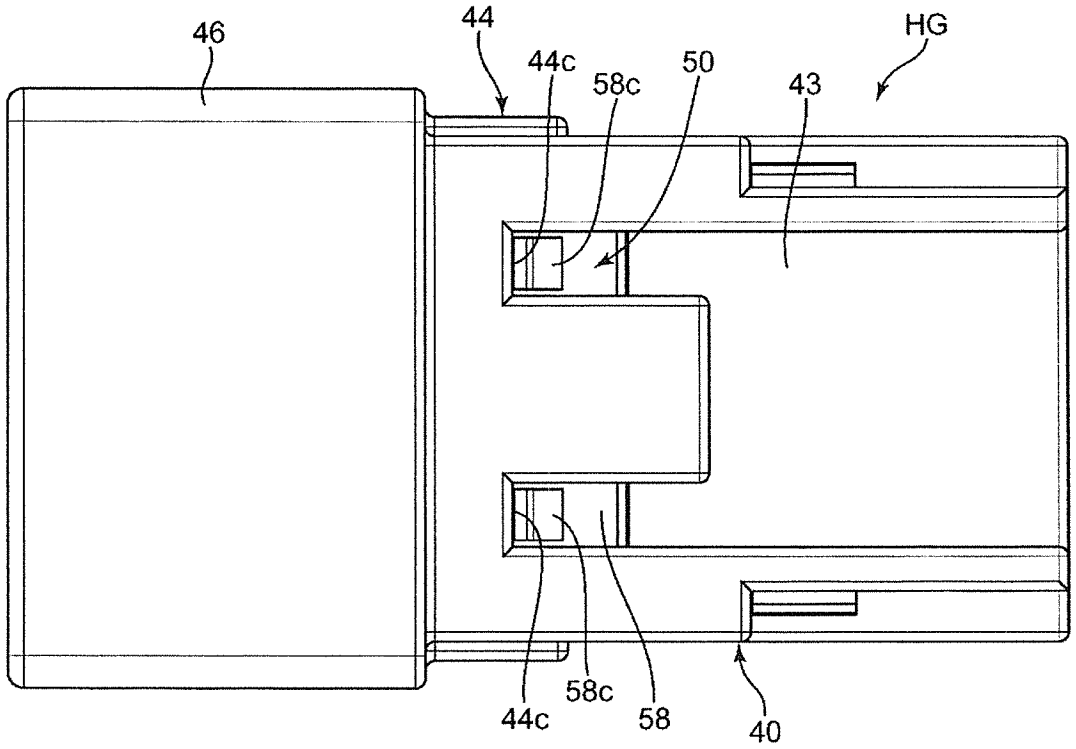
FIG. 6 is a plan view of the joint connector.
Figure 7:
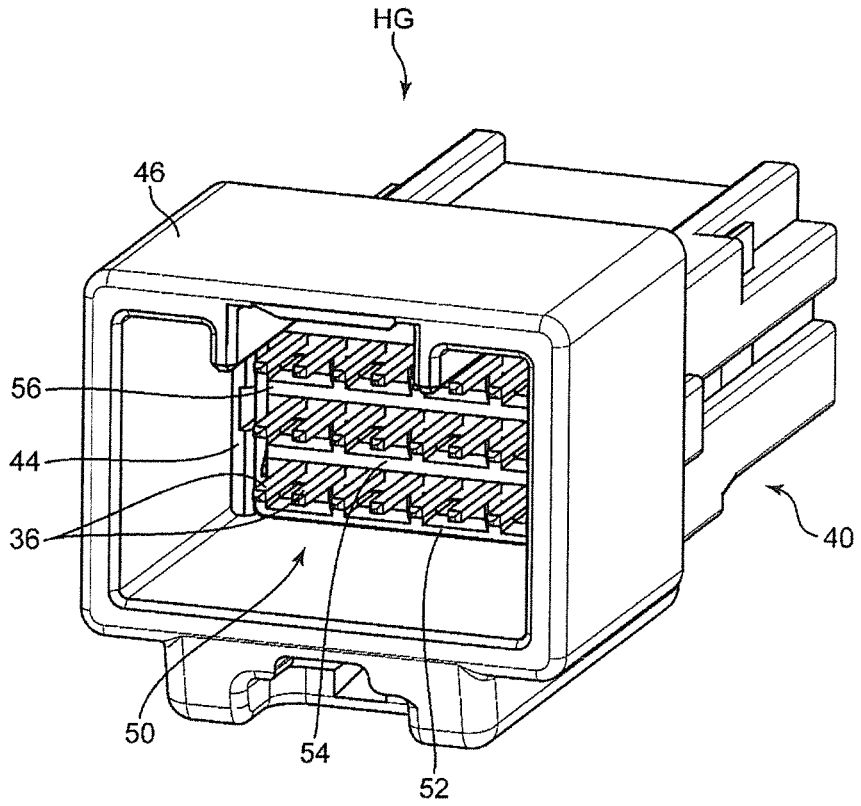
FIG. 7 is a perspective view of the joint connector viewed from the side of a receptacle.

The casing 44 of the outer portion 40 accommodates and holds the entire shorting member accommodating portion 50, as described above. A step 45, as shown in FIGS. 4 and 5, is formed at a boundary between the casing 44 and the terminal holding portion 43 and constrains an end of the shorting member holding portion 50 on the side of the terminal holding portion 43. Further, the casing 44 includes constraining surfaces 44*k* (FIG. 3) and constraining surfaces 44*c* (FIGS. 1 and 3) for constraining the shorting member holding portion 50 from a side opposite to the step 45 by respectively contacting the two locked projections 54*k* and the two locked projections 58*c* included in the shorting member holding portion 50.

The receptacle 46 is shaped to surround each second shorting-side terminal 36 projecting from the shorting member accommodating portion 50 and receives an inserted housing of the mating connector CC. As just described, this receptacle 46 constitutes a connector part connectable to the mating connector CC together with the respective second shorting-side terminals 36.

In the joint connector described above, the respective shorting members 30 can be held in the insulating housing HG by fitting the shorting members 30 into the recesses 52*d*, 54*d* and 56*d* of the lower clamping portion 52 and the first and second intermediate clamping portions 54, 56, stacking the clamping portions 52, 54, 56 and 58 in this order and constraining the lower and upper clamping portions 52, 58 by the clamping/fixing arms 59, and storing and fixing the shorting member holding portion 50 constructed in this way into the outer portion 40. By fitting the wire-side terminals 20 and the terminals of the mating connector CC to the respective shorting-side terminal portions 34, 36 in this state, a good shorting circuit can be formed.

The respective clamping portions 52, 54, 56 and 58 of the shorting member holding portion 50 vertically clamp the respective shorting members 30. More particularly, the lower clamping portion 52 and the first and second intermediate clamping portions 54, 56 respectively include the first and second constraining protrusions 52*b*, 52*c*, 54*b*, 54*c*, 56*b*, and 56*c* for constraining the shorting members 30 in the first and second projecting directions. Thus, the shorting member holding portion 50 can hold the respective shorting members 30 with a holding force sufficient to resist fitting forces acting on the shorting members 30 without requiring the shorting members 30 to be press-fit tightly into the shorting member holding portion 50.

The present invention is not limited to the embodiment described above. The invention may include, for example, the following configurations.

The shorting member is not limited to the one including the shorting-side terminal portions 34, 36 respectively projecting in the first and second projecting directions from the base like the shorting member 30. For example, the shorting member may be such that shorting-side terminals project from the base only in one direction intersecting with the shorting direction, which is the longitudinal direction of the base.

The shape of the shorting member constraining portions provided in the clamping portion can also be set according to the specific shape of the shorting member. Taking the first intermediate clamping portion 54 as an example, the clamping portion may include only some of the first to third constraining protrusions 54*b*, 54*c* and 54*h* of the first intermediate clamping portion 54. Thus, the shorting member constraining portions only have to be able to exert a holding force to hold the shorting member against a fitting force (external force in a direction parallel to the terminal projecting direction) acting on the shorting member.

The invention is not intended to completely exclude the press-fitting of the shorting member into the shorting member holding portion. For example, it is not excluded to lightly press-fit the shorting members 30 into the recess 52*d*, 54*d*, 56*d*. Since the press-fitting does not directly contribute to the holding of the shorting member 30, the fracture of the clamping portion 52, 54, 56 or the shorting member 30 can be avoided by reducing press-fitting resistance.

The shorting member holding portion of the joint connector may hold only a single shorting member. However, by providing a plurality of shorting members as described above, more wires can be shorted to each other. In this case, if the shorting members are arranged in a direction parallel to the clamping direction and the shorting member holding portion includes a common clamping portion commonly used as the second clamping portion for a specific shorting member and the first clamping portion for the shorting member adjacent to the specific shorting member, each shorting member can be held efficiently by a structure with a small number of components.

The clamping/fixing portion merely has to fix relative positions of the first and second clamping portions. For example, the clamping/fixing portion may be provided between the lower clamping portion 52 and the first intermediate clamping portion 54, between the first intermediate clamping portion 54 and the second intermediate clamping portion 56 and between the second intermediate clamping portion 56 and the upper clamping portion 58. However, the clamping/fixing arms 59 according to the above embodiment for coupling the outer clamping portions (lower and upper clamping portions 52, 58 in this embodiment) to each other are advantageous in being able to fix relative positions of all the clamping portions by a simple structure.

Further, the clamping/fixing portion is not limited to the one integrally formed to some clamping portion like the clamping/fixing arms 59 and may be, for example, configured as a member different from each clamping portion.

The specific structure of the insulating housing does not matter. For example, the outer portion 40 can be omitted partially or entirely.

The invention claimed is:

1. A joint connector for shorting wires to each other by electrically connecting wire-side terminals respectively mounted on ends of the wires to each other, comprising:

a shorting member made of a conductive material, the shorting member integrally including a base extending in a shorting direction and shorting-side terminal projecting from the base in a terminal projecting direction intersecting the shorting direction, each shorting-side terminal portion being shaped to fit to each wire-side terminal; and an insulating housing having a shorting member holding portion for holding the shorting member;

wherein the shorting member holding portion includes first and second clamping portion divided from each other in a clamping direction perpendicular to the shorting direction and the terminal projecting direction and capable of clamping the shorting member from both sides in the clamping direction, and a clamping/fixing portion for constraining the first and second clamping portions to each other to fix relative positions of the first and second clamping portions at clamping positions where the first and second clamping portions clamp the shorting member from both sides in the clamping direction, and at least one of the first and second clamping portions is a constraining clamping portion including a shorting member constraining portion for constraining the shorting member to restrict a relative displacement of the shorting member in the terminal projecting direction with respect to the first and second clamping portion at the clamping position.

2. The joint connector of claim 1, wherein the first and second clamping portions include clamping surfaces facing each other in the clamping direction at the clamping positions, and the shorting member constraining portion includes constraining protrusions projecting from the clamping surface of the constraining clamping portion toward the mating clamping portion.

3. The joint connector of claim 2, wherein the constraining protrusions include those for constraining the base portion in a direction parallel to the terminal projecting direction by being located at positions between adjacent ones of the plurality of shorting-side terminal portions and near the base and constraining the shorting-side terminal portions in a direction perpendicular to the terminal projecting direction.

4. The joint connector claim 2, wherein the shorting member includes a through hole penetrating through the base thereof in a direction parallel to the clamping direction, and the constraining protrusions include a through hole inserting protrusion to be inserted into the through hole in the direction parallel to the clamping direction at the clamping position.

5. The joint connector of claim 1, further comprising a plurality of the shorting members arranged in a direction parallel to the clamping direction, wherein the shorting member holding portion includes the first and second clamping portions for each shorting member.

6. The joint connector of claim 5, wherein the shorting member holding portion includes a common clamping portion interposed between mutually adjacent ones of the plurality of shorting members and commonly used as the first clamping portion for one of the mutually adjacent shorting members and as the second clamping portion for the other shorting member.

7. The joint connector of claim 5, wherein the clamping/fixing portion collectively fixes relative positions of the first and second clamping portions for clamping each of the shorting members at the clamping positions by coupling both outer clamping portions located on both outer sides in a direction parallel to the clamping direction.

8. The joint connector of claim 7, wherein the clamping/fixing portion is formed to be integrally connected to one of the both outer clamping portions.

* * * * *